United States Patent [19]

Carpenter, Jr.

[11] 4,051,699

[45] Oct. 4, 1977

[54] LIQUID AMMONIA MERCERIZATION

[75] Inventor: John B. Carpenter, Jr., Greensboro, N.C.

[73] Assignee: Burlington Industries, Inc., Greensboro, N.C.

[21] Appl. No.: 616,818

[22] Filed: Sept. 25, 1975

[51] Int. Cl.[2] ..... D06B 1/14; D06B 5/08; D06B 7/08

[52] U.S. Cl. ..... 68/5 D; 26/27; 68/13 R; 68/19; 68/202

[58] Field of Search ..... 68/5 D, 5 E, 13 R, 19, 68/19.1, 20, 202, 203, DIG. 5; 8/125, 149.1; 26/2 R, 27; 28/76 P

[56] References Cited

U.S. PATENT DOCUMENTS

| | | | |
|---|---|---|---|
| 1,917,555 | 7/1933 | Shuttleworth | 26/2 R |
| 2,193,340 | 3/1940 | McConnell | 8/125 X |
| 3,045,318 | 7/1962 | Kern | 8/125 X |
| 3,406,006 | 10/1968 | Lindberg et al. | 8/125 |
| 3,406,462 | 10/1968 | Fleissner | 68/DIG. 5 |
| 3,492,838 | 2/1970 | Reiners et al. | 68/5 D |
| 3,503,134 | 3/1970 | Fleissner | 68/DIG. 5 |
| 3,589,030 | 6/1971 | Troope et al. | 68/5 D X |
| 3,664,158 | 5/1972 | Skaathun et al. | 68/19.1 X |
| 3,721,097 | 3/1973 | Briley et al. | 62/11 |

FOREIGN PATENT DOCUMENTS

| | | | |
|---|---|---|---|
| 883,001 | 3/1943 | France | |
| 1,365,706 | 9/1974 | United Kingdom | 68/5 D |

*Primary Examiner*—Philip R. Coe
*Attorney, Agent, or Firm*—Cushman, Darby & Cushman

[57] ABSTRACT

Apparatus for mercerization of cellulosic fabrics with liquid ammonia. Denim fabrics and the like, especially those made from open-end spun yarn, have liquid ammonia for mercerization applied thereto by a metering roller while tensioned. The metering roller has a number of deep engravings formed in the periphery thereof, which may be in the form of a truncated cone or a tetrahedron. Pile or ribbed fabrics are treated by application of liquid ammonia with a metering roller to the back of the fabric, while tension is maintained by relatively gentle apparatus, such as a pinned drive cylinder. When fabric direction is changed, soft rollers engage the fabric face to change the direction, and the fabric face is brushed with rotary driven brushes of Nomex or the like. Final ammonia removal from the fabric is facilitated by passing the fabric over a large cylinder with a perforated surface, steam transfer occurring across the fabric in the steam chamber.

8 Claims, 6 Drawing Figures

LIQUID AMMONIA MERCERIZATION

BACKGROUND AND SUMMARY OF THE INVENTION

Mercerization of cellulosic fabric is a common method of treating fabrics. In the past, mercerization has been performed with caustic soda; however, oftentimes this can result in degradation of the fabric material. Recently it has been proposed to mercerize fabrics with liquid ammonia. Mercerization of cellulosic fabrics with liquid ammonia causes the cellulose fibers to swell and become more porous and more accessible, giving increased dye, flame retardant, and resin affinity, and like desirable characteristics. Exemplary prior art apparatus and methods for mercerization with liquid ammonia are shown in British Pat. No. 1,365,706, and U.S. Pat. Nos. 3,406,006 and 3,664,158.

Prior art methods and apparatus for liquid ammonia mercerization, such as shown in British Pat. No. 1,365,706, have generally been designed for denim fabrics and the like made from ring-spun yarn. When denim made from open-end spun yarn, or the like, or pile or ribbed fabrics are treated, problems are encountered. Since open-end spun yarn fabrics absorb more liquid ammonia than ring-spun yarn fabrics, removal of the ammonia therefrom is not possible in conventional machines at full production speed, and other problems (such as excessive shrinkage or a requirement for expensive machinery to eliminate excessive shrinkage) also may be encountered. With pile or ribbed fabrics, such as corduroy and velvet, the faces of the fabrics are crushed by the impregnating and tensioning means normally associated with conventional machinery. Also, complete efficient ammonia removal from such fabrics does not take place without face crushing.

According to the apparatus of the present invention, the above-mentioned problems prevalent in the prior art are solved. When treating cellulosic fabrics such as denim, especially those made from open-end spun yarn, according to the present invention the liquid ammonia is metered onto the fabric by passing the fabric over a metering roller. The metering roller has deep engravings formed on the surface thereof, in the form of truncated cones, tetrahedrons, or the like. Deep engravings are necessary because of the low viscosity and low density of liquid ammonia. After the ammonia is applied to the fabric, it is removed by any suitable conventional means while the tension is maintained thereon, such as the tensioning and removal means disclosed in British Pat. No. 1,365,706. The metering roller applies less ammonia to the fabric than absorbed thereby when immersed, less ammonia than this being needed for proper mercerization.

When pile or ribbed fabric is treated according to the present invention, the liquid ammonia is applied thereto by passing the back of the fabric over a metering roller, care being taken not to disturb the face thereof. Since conventional tension applying means tend to crush the face of the pile fabric, tensioning of the pile fabric is accomplished merely by engagement thereof by a plurality of pins or the like on the periphery of a drying can or heated cylinder or the like that participates in the ammonia removal. Whenever the direction of fabric movement need be changed, rollers having a surface of soft material that is chemically resistant to the ammonia environment (such as Nomex (aramide) by Dupont) engage the face of the fabric to perform the direction changing. Rotary driven brushes, which also may be of Nomex, are also provided to brush the fabric face and restore it to its original condition. After preliminary removal of the ammonia on one or more drying cans or the like, the fabric may be passed into a steam chamber and over a large cylinder having a perforated surface, a steam flow being maintained through the fabric between the interior of the steam chamber and the interior of the cylinder. Again soft rollers and brushes can be used on the fabric face as it passes over the cylinder surface for final ammonia removal.

It is the primary object of the present invention to provide improved apparatus for cellulosic fabric mercerization, especially for cellulosic fabrics made from open-end spun yarn and for pile and ribbed fabrics. This and other objects of the invention will become clear from an inspection of the detailed description of the invention, and from the appended claims.

BRIEF DESCRIPTION OF THE DRAWINGS

FIG. 1*c* is another embodiment of tensioning and drying means that may be used with the apparatus of FIG. 1*a* when treating denim fabrics, or the like;

DETAILED DESCRIPTION OF THE INVENTION

Figure 1A:
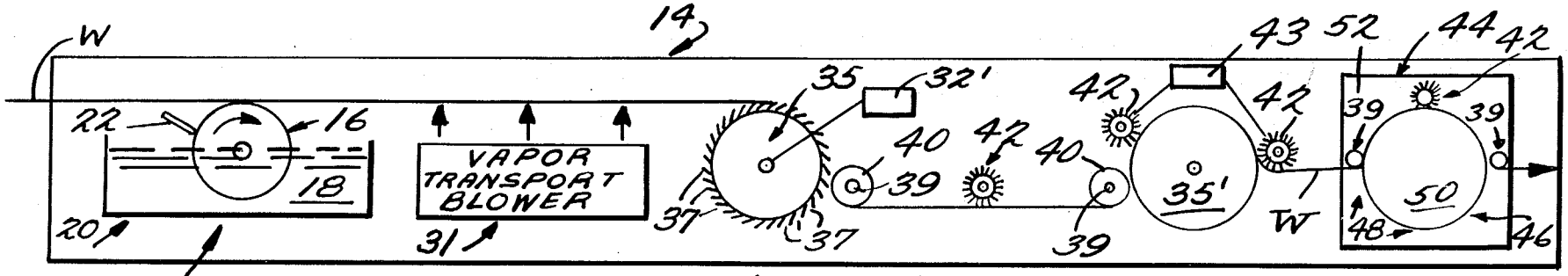
FIG. 1*a* is a schematic view of exemplary apparatus for practicing a method of mercerization with liquid ammonia according to the present invention.

Mercerization of cellulosic fabrics with liquid ammonia has been recognized in U.S. Pat. Nos. 3,406,006 and 3,664,158, and in British Pat. No. 1,365,706. Such treatment causes the cellulosic fibers to swell, making them more porous and more accessible so that their affinity for dyes, flame retardants, resins, and the like is enhanced, without the destructive effects thereon often associated with mercerization by caustic-soda solutions. Improved apparatus for mercerization of particular types of cellulosic fabrics, and cellulosic fabrics in general, and for practicing the method according to the present invention is shown schematically in FIG. 1*a*. The invention includes an improved liquid ammonia impregnation station 10, and improved first and second removal stations 12 and 13 all disposed in a cabinet 14 or the like. The temperature and pressure conditions are controlled in the cabinet 14 to insure optimum saturation of the atmosphere therein with ammonia, and to control the state of the ammonia in the cabinet 14, etc. Conventional seals are provided for cabinet 14 at the entrance and exit of web W. The means for controlling the atmospheric and temperature conditions may include any conventional means, such as shown in British Pat. No. 1,365,706 or U.S. Pat. No. 3,664,158.

The improved impregnation station 10 preferably includes a metering roller 16 or the like for kiss coat application of the liquid ammonia 18 to a fabric web W, rather than the conventional liquid ammonia bath and associated nip rollers such as disclosed in British Pat. No. 1,365,706. Cellulosic fabrics from ring-spun yarn pick up 70–80% liquid ammonia on fabric weight when subjected to impregnation according to conventional techniques, while open-end spun fabrics increase the pick-up of liquid ammonia over ring-spun fabrics in the order of 20%. Thus, there is often a problem of attaining sufficient ammonia removal in limited apparatus space, which problem is magnified in the case of fabrics from open-end spun yarns, resulting in either incomplete ammonia removal or a slowing of production capacity so that proper removal may be achieved. When using a metering roller 16 according to the present invention, however, the pick-up of ring-spun yarns is preferably reduced to approximately 50%, and so with open-end spun yarns. This is because only a predetermined amount of liquid ammonia is applied to the fabric, rather than allowing the fabric to absorb as much as it can as in the conventional bath treatment.

Figure 1C:
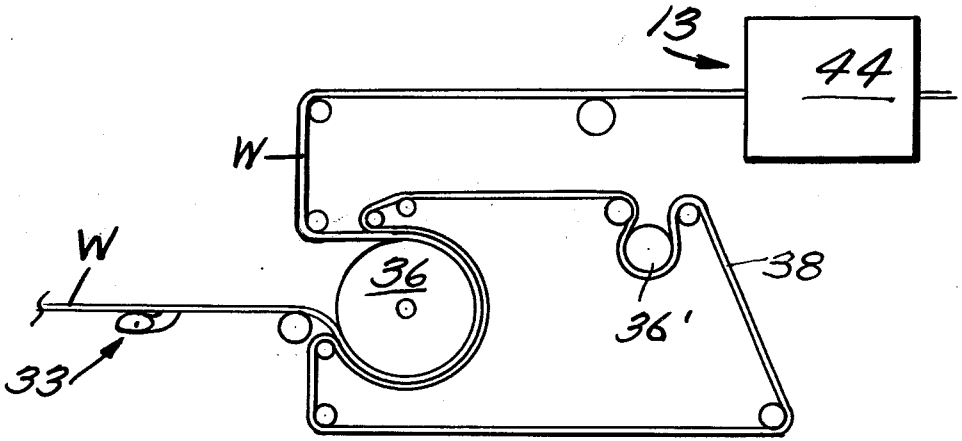
Figure 1B:
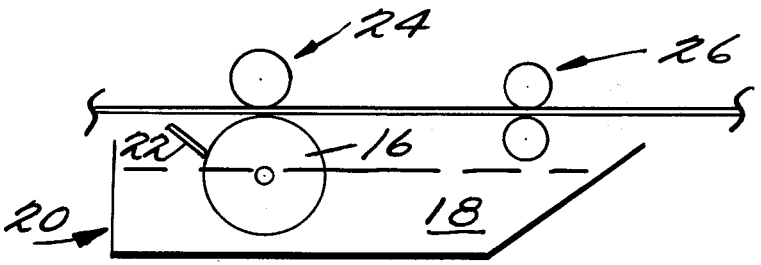
FIG. 1*b* is another embodiment of metering roller means that could be used in the apparatus of FIG. 1*a;*

As shown in FIG. 1*a*, the fabric web W preferably passes over and in contact with a single metering roller 16 which rotates in an open pan 20 or the like of liquid ammonia 18. A doctor blade 22 may be provided to cooperate with the periphery of the roller 16 to more precisely control ammonia pick-up if desired. As shown in FIG. 1*b*, if desired another roller 24 may cooperate with the roller 16 (especially for denim and the like but preferably not for pile or ribbed fabrics), and/or nip rollers 26 may be provided to aid the even distribution of the liquid ammonia applied to the fabric web W. The amount of liquid ammonia applied to the web W will generally be predetermined to be an amount sufficient for proper mercerization that can be readily removed by drying apparatus of normal length, an amount less than is normally picked up by immersion of the fabric in a bath.

Figure 2:
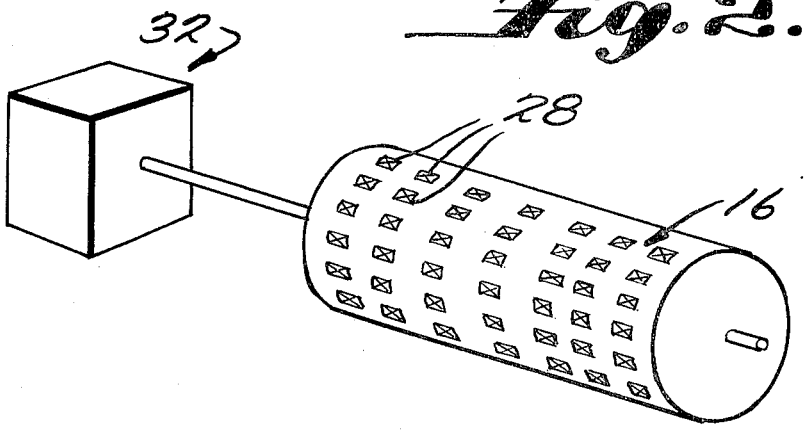
FIG. 2 is a perspective diagrammatic view of a metering roller according to the present invention.
Figure 3A:
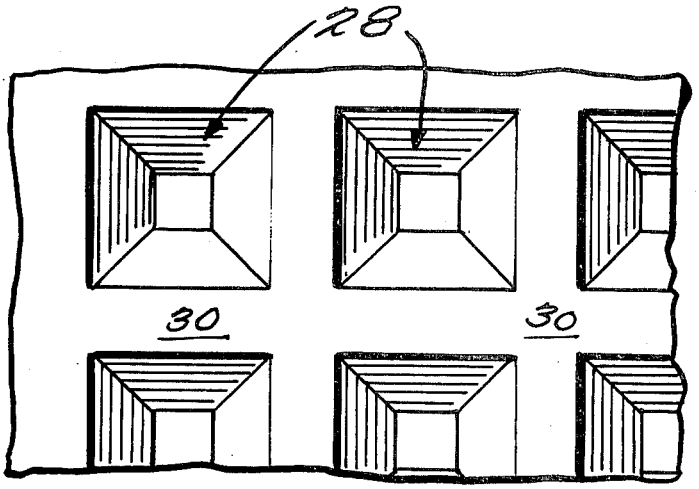
FIGS. 3*a* and 3*b* are detail views of various surface engravings that may be utilized in the metering roller of FIG. 2.
Figure 3B:
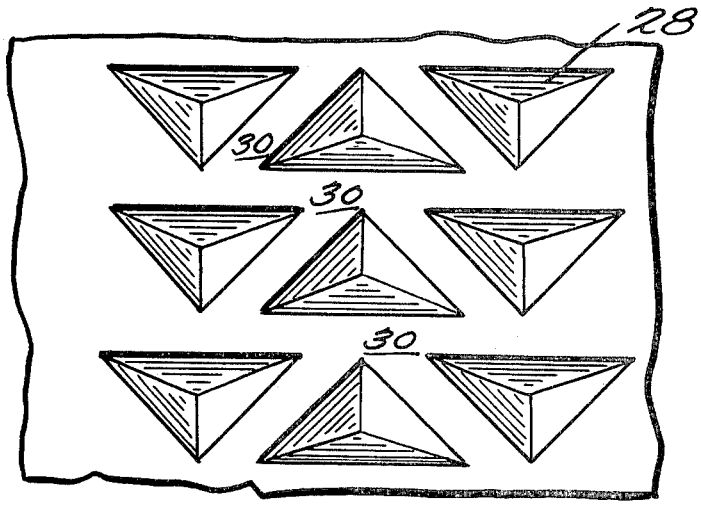

Since the viscosity of liquid ammonia is 0.241 centipoise, as compared to 1.0 centipoise for water, the mobility of ammonia is much greater than the mobility of water, and the metering roller 16 must be constructed with this in mind. Allowance must also be made for the low density, 0.62. Typically, the metering roller 16 assumes the form shown in FIGS. 2, 3*a*, and 3*b*. A plurality of deep depressions 28 are disposed along the periphery of the roller 16, roller surface areas 30 being present between the depressions 28. The depressions 28 are suitably in the form of a truncated cone, as shown in FIG. 3*a*, or a tetrahedron, as shown in FIG. 3*b*. The liquid ammonia is picked up from the pan 20 by the deep depressions 28, and carried to the bottom face of the web W and applied thereto at that position. Migration of the ammonia through the web W may be facilitated, if desired, by a conventional fan or blower 31 or the like disposed below the web W. The number of engravings or depressions 28 per square inch generally will be lower at usual fabric speeds than for comparable aqueous pick-up. In aqueous systems the number of engravings varies from 45 engravings/in$^2$ to 110 engravings/in$^2$, and the roll speed is substantially the same as the cloth speed. The speed of roller 16 is controlled by drive means 32 or the like therefore. In general, by uniformly metering with metering roller 16 a prescribed amount of ammonia, mercerization with increased machine capacity can be achieved.

When treating denim fabrics, either from ring-spun yarn or open-end spun yarn, the same tensioning control means as is provided in British Pat. No. 1,365,706 (bow rollers and associated elements) or U.S. Pat. No. 3,664,158 may be utilized. Exemplary means for this are shown schematically in FIG. 1*c*, wherein a bow roller 33 or the like is provided for tensioning of the fabric, and wherein initial ammonia removal therefrom is accomplished by passing the fabric over a dryer drum 36 or the like by means of a blanket 38 cooperating with a roller system and another dryer drum 36' or the like. The web W may be passed through a steam chamber 44 or the like after initial removal of ammonia by drum 36. When pile or ribbed fabric webs, such as corduroy and velvet, are treated, however, such tension control means have a tendency to crush the face of the fabric. By utilizing improved tensioning control means in the removal station 12 according to the present invention, however, crushing of the fabric face can be minimized, and the fabric mercerized while maintaining its desired face characteristics.

According to the present invention, ammonia removal station 12 preferably includes a plurality of drying cans or heated cylinders 35, 35', and the like. The can or cylinder 35 disposed closest to the ammonia impregnation station 10 has disposed on the periphery thereof a plurality of pins 37 or the like for controlling fabric web W tension. The surface of the cylinder 35 may serve as a transport for a pin chain, or the pins 37 may be attached directly to the surface of the cylinder 35. A tensioning cylinder with pins that is not a drying cylinder may alternatively be provided. Cylinder 35 is driven by a drive means 32' at a given rate to provide proper tension in the web W while not causing damage thereto. After passing over cylinder 35, the fabric direction may be changed by soft guide rollers 39 or the like, and the fabric web W passed over a second drying can or heated cylinder 35', or more if desired. The guide rollers must be of special construction since they will engage the face of the fabric web W — care must be taken to see that the face is disturbed as little as possible. The surfaces of the rollers 39 preferably are like that of a soft buffing wheel, and they must be made of a material that is chemically resistant to the ammonia atmosphere in the cabinet 14. Preferably, the surfaces of the rollers 39 may be formed of Nomex (aramide), manufactured by Dupont. The Nomex (aramide) may be disposed around the roller 39 as a pile-surfaced blanket 40, if desired.

The first cylinder in removal station 12 according to the present invention, in addition to providing proper tension control, also disposes the pile fabric so that the face thereof has a minimum of contact with accessory elements, and so that brushing thereof to restore its natural appearance is possible. A plurality of brushes 42 may be provided between the rollers 39 and in other positions to brush the fabric face. The brushes 42 are preferably rotary brushes driven by driving means 43 or the like. The brushes 42 are driven at different speeds from the cloth. The brushes must be formed of some relatively soft material (of generally the same physical properties as animal hair brushes) which is chemically resistant to the ammonia atmosphere in cabinet 14. Nomex is also a suitable material for the brushes 42.

After initial removal of ammonia from the fabric web W in station 12, the remainder of the ammonia may be removed, according to the present invention, in second removal station 13 in an improved steam chamber 44 or the like. Conventional seals are provided for chamber 44. Disposed in the steam chamber 44 is a large cylinder or can 46 having a perforated surface 48. The perforations in the surface 48 may be small slots or geometrics as represented by a honeycomb, and the open surface area of the cylinder 46 is preferably relatively large. Either the interior 50 of cylinder 46 may be used for a plenum with the interior 52 of the chamber 44 leading to a vapor recovery unit, or the interior 52 of the chamber 44 may be used as a plenum with the interior 50 of the cylinder leading to a vapor recovery unit. In either case the steam is forced through the fabric web W, resulting in final removal of the ammonia in the web W. Not only does such an arrangement result in a more efficient removal of the ammonia from the fabric, but it also allows pile or ribbed fabrics to be treated without destruction of the face thereof. When pile or ribbed fabrics are treated, rollers 39 and a brush (or brushes) 42 are provided to insure that the face of the fabric is constantly being restored. When pile fabric is not being treated, conventional rollers may be substituted for the rollers 39, and the brush(es) 42 eliminated.

It will thus be seen that according to the present invention, a method of operation of apparatus is provided for mercerization of cellulosic fabric, such as denim made from open-end spun yarns, by applying a metered amount of liquid ammonia 18 to the fabric by passing the fabric over a metering roll 16 having deep engravings 28, and controlling the roller speed to insure less than maximum pick-up of ammonia by the fabric. The ammonia is then removed from the fabric by conventional means, such as shown in British Pat. No. 1,365,706 (and FIG. 1*c*), and/or by passing it over a perforated cylinder 46 in a steam chamber 44, a steam flow being maintained between the interior of the chamber and the interior of the perforated cylinder.

Also according to the present invention, a method of operation of apparatus is provided for mercerization of a cellulosic ribbed or pile fabric by metering the amount of liquid ammonia applied to the fabric by passing the back of the fabric over a metering roll 16, controlling the tension of the fabric with pins 37 associated with a first drying cylinder 35 or the like, the fabric being passed over the first drying cylinder, and transferring the fabric from the first cylinder 35 to a second cylinder 35' by changing the fabric direction by contacting the fabric face with guide rollers 39, and brushing the fabric face (with brushes 42) to restore the original appearance thereof. The fabric is then further treated to remove the rest of the ammonia therefrom, as by passing the fabric over a perforated cylinder 46 in a steam chamber 44, a steam flow being maintained between the interior of the chamber and the interior of the perforated cylinder.

While the invention has been herein shown and described in what is presently conceived to be the most practical and preferred embodiments, it will be apparent to one of ordinary skill in the art that many modifications may be made thereof within the scope of the invention, which scope is to be accorded the broadest interpretation of the appended claims so as to encompass all equivalent structures and devices.

What is claimed is:

1. Apparatus for mercerization of a cellulosic pile or ribbed fabric, the fabric having a pile or ribbed face and a back, said apparatus comprising means for applying a predetermined amount of liquid ammonia to said fabric less than the amount that would be picked up by said fabric if immersed in liquid ammonia, said means including a metering roller partially disposed in a pan of liquid ammonia and having a surface for engaging the back of said fabric, and means for rotating said metering roller at a predetermined rate, said metering roller having a plurality of deep engravings formed in the surface thereof, means for tensioning said fabric so that the face thereof is not disturbed after application of liquid ammonia to said fabric, said means including a first cylinder having a plurality of pins associated with the peripheral surface thereof for engaging the back of said fabric, means for facilitating the removal of ammonia from said fabric by changing the direction of fabric movement without damaging the fabric face and drying said fabric, said means including a plurality of guide rollers for engaging the fabric face and changing the direction of fabric movement, and a second, heated, cylinder for engaging the back of said fabric, means for brushing the fabric face to substantially restore the original appearance thereof, and means for further treating said fabric as necessary to remove all of the ammonia therefrom.

2. Apparatus as recited in claim 1 wherein said means for brushing the fabric face includes a rotary brush and means for rotating said brush.

3. Apparatus as recited in claim 2 wherein said brush is made of aramide.

4. Apparatus as recited in claim 1 wherein each of said guide rollers has the periphery thereof made of aramide.

5. Apparatus as recited in claim 1 further comprising means for enhancing ammonia transfer through said fabric from back to face after application of ammonia to the back of said fabric, said means including means for blowing ammonia vapor through said fabric from the back to the face thereof.

6. Apparatus as recited in claim 1 wherein said means for further treating said fabric as necessary to remove all of the ammonia therefrom includes a steam chamber having a perforated cylinder disposed therein, the surface of said perforated cylinder for engaging the back of said fabric, means for causing a steam transfer through said fabric in said steam chamber, and means for brushing the fabric face as said fabric passes over said perforated cylinder.

7. Apparatus as recited in claim 1 further comprising a doctor blade cooperating with said metering roller to gauge the amount of liquid ammonia transferred from said roller to said fabric.

8. Apparatus for mercerizing a cellulosic pile or ribbed fabric, the fabric having a pile or ribbed face and a back, comprising means for applying a predetermined amount of liquid ammonia to said fabric less than the amount that would be picked up by said fabric if immersed in liquid ammonia, said means including a metering roller partially disposed in a pan of liquid ammonia and having a surface for engaging the back of said fabric, and means for rotating said metering roller at a predetermined rate, said metering roller having a plurality of deep engravings formed in the surface thereof, means for removing a portion of the ammonia from said fabric without damaging the face thereof by treatment at a first removal station, means for removing the rest of the ammonia from said fabric at a second removal station, and means for enchancing ammonia transfer through said fabric for complete penetration thereof after application of ammonia to the back thereof, said means comprising means for blowing ammonia vapor through said fabric from the back to the face thereof.

* * * * *